United States Patent [19]

Silver et al.

[11] Patent Number: 4,496,073

[45] Date of Patent: Jan. 29, 1985

[54] CRYOGENIC TANK SUPPORT SYSTEM

[75] Inventors: David M. Silver, Bethesda; Newman Dehaas, Silver Spring, both of Md.

[73] Assignee: The Johns Hopkins University, Baltimore, Md.

[21] Appl. No.: 469,451

[22] Filed: Feb. 24, 1983

[51] Int. Cl.[3] ..... F17C 1/12

[52] U.S. Cl. ..... 220/445; 62/45; 220/901

[58] Field of Search ..... 62/45; 220/445, 901, 220/902, 420, 448, 423, 437, 435; 280/5 C, 5 G; 206/591, 583

[56] References Cited

U.S. PATENT DOCUMENTS 2,071,728 2/1937 Bursitzky ..... 220/447 X 3,365,092 1/1968 Blessing ..... 220/447

*Primary Examiner*—Stephen Marcus
*Assistant Examiner*—Robert Petrik
*Attorney, Agent, or Firm*—Robert E. Archibald; Leonard W. Pojunas, Jr.

[57] ABSTRACT

A single-stage cryogenic tank support system is disclosed having a large-radius support tube surrounding an internal storage tank, both of which are enclosed by an external shell. The attachment tube is secured to the internal storage tank and external shell by cold and hot support rings, respectively, in a manner that inhibits thermal conductivity, provides low bending stress to the system, and avoids resonant vibrations of the system at low frequencies.

18 Claims, 14 Drawing Figures

CRYOGENIC TANK SUPPORT SYSTEM

STATEMENT OF GOVERNMENT INTEREST

The Government has rights in this invention pursuant to Contract No. N00024-83-C-5301, awarded by the Department of the Navy.

FIELD OF THE INVENTION

The invention relates to a single stage suspension system for the inner vessel within an outer vessel of a Dewar-type cryogenic tank: a suspension system which has provision for preventing low-frequency resonant vibrations, which can withstand large dynamic forces, and which inhibits heat transfer between the two vessels. More generally, the invention relates to any application in which a mass at one temperature is supported within a vessel at another temperature, such as in the storage of cryogenic fluids and in superconducting magnet cryostats where heat transfer between the mass and vessel is to be minimized, and wherein large dynamic forces and low frequency resonant vibrations acting on the supported mass are to be prevented.

Dewar-type containers or cryogenic tanks are well known devices for storing cryogenic fluids. For instance, cryogenic tanks are commonly used to store large quantities of liquid nitrogen and oxygen at hospital compounds, on industrial sites, and aboard ships for long periods. The transportation industry also utilizes cryogenic tanks when shipping cryogenic fluids via tank trucks or rail cars. Liquid natural gas (LNG) is stored in relatively small amounts on cryogenic tank carrying vehicles, wherein the LNG is used as a propellant for the vehicle.

In order to retain the cryogenic liquids in their tanks for long periods, it is necessary to design the tanks for low rates of heat transfer from the outer vessel to the cryogenic liquid. Further, cryogenic tanks are generally structured to withstand the pressure and weight of any fluid stored therein, the weights of the inner and outer vessels, the forces produced by the usual evacuation of the space between the vessels, and any dynamic forces externally imposed on the tank system. The dynamic forces usually included in the design are those experienced by a cryogenic tank while being transported over road or rail. But there are sources of dynamic forces which are much larger than the normal forces experienced in transport, such as collision of the transporting vehicle with any other vehicle or object, the detonation of high explosives or their equivalent, the acceleration of a launching rocket, and for fixed-site storage tanks—earthquakes. In some applications of a Dewar-type cryogenic tank, it is important to design and construct the tank so as not to be resonant with any externally imposed vibration, such as might be transmitted from or through a vehicle carrying the tank assemblage, because a resonant condition could destroy the support system for the inner vessel. The vibrational frequencies that are the most troublesome are those that are in the low-frequency range.

The Dewar-type cryogenic storage tank described herein is one in which the system for suspending the inner vessel within the outer vessel is capable of preventing low-frequency resonant vibrations, can withstand large shock forces, and which inhibits heat transfer between the outer vessel and the stored cryogen liquid. It is also a space-efficient design, which is important since many of the possible applications of the herein described cryogenic storage tank will involve the containment of the tank in a transporting vehicle.

Numerous cryogenic tank designs have been proposed previously.

For instance, U.S. Pat. No. 4,000,826 to Rogers describes a transportation tank which is comprised of a cylindrical tank portion with hemispherical heads. The cylindrical portion is surrounded by a corrugated shell and a vacuum/insulation space therebetween, while the heads, which have a vacuum/insulation space on its interior, are exposed to the environment. The cylindrical portion between the inner and outer vacuum/insulation zone provides the thermal path between the tank contents and the environment. No discussion is made in regard to sustaining shock loads in excess of those experienced in normal transport, nor is mention made of resonance frequencies.

In U.S. Pat. No. 3,341,215 to Spector, a tank is disclosed having support tubes inside a storage tank and an outer tank which encloses the storage tank. The use of an internal support tube, having a small radius and cross-sectional area relative to the surrounding storage and outer tanks, minimizes the heat transfer but sacrifices support strength and may allow low-frequency resonances.

It is apparent that a longitudinal support tube which passes through the storage tank center consumes valuable storage space, particularly if the longitudinal support tube is of large diameter. To minimize the consumption of space resulting from the use of such a full-length center support tube, cryogenic vessels have been proposed which utilize support devices mounted at the longitudinal ends of the storage tank. See U.S. Pat. No. 3,217,920 to Holben, for instance, in which tubular support sections connect inner storage member ends to adjacent external shell ends. The device described by Hampton et al, in U.S. Pat. No. 3,782,128 also avoids the necessity of a central support tube. The cryogenic tank system shows an inner container, heat shield and outer jacket connected at their ends via a spoked support apparatus: a first spoke arrangement connects the inner container longitudinal end to the heat shield, and a second spoke arrangement connects the heat shield longitudinal end to the outer jacket.

Other Dewar devices have been suggested that emphasize support strength. U.S. Pat. No. 3,905,508, issued to Hibl et al, discusses a multistage tank support system with an internal support beam, designed to withstand high inertial loads. The amplitude of an inertial load applied to the system determines which support stage is engaged. Small inertial loads are absorbed by a central beam, the first support stage. Increased inertial loads deflect the central beam until inner vessel ends contact the beam at a point much closer to its attachment to the outer vessel, thus enabling it to carry larger inertial loads than the first stage alone. Kirgis et al show, in U.S. Pat. No. 3,487,971, a cryogenic tank system with an inner vessel enclosed by a heat shield, both of which are encased by an outer vessel. The vessels and shields are separated by resilient elements that provide the only path of conductive heat transfer to the inner vessel. When subjected to substantial "g" loads, such as during launch of a rocket carrying this tank system, the resilient elements compress until more dense elements are engaged to support the inner vessel, the resilient and more dense elements comprising a two-stage support.

It is seen from these examples of cryogenic tanks designs and from others not cited that few are concerned about designing for high dynamic forces and that designs with a concern for resonant frequencies are rare. The invention described herein provides a novel way to design for high dynamic forces and the avoidance of low resonant frequencies in the same support mechanism without degrading the cryogen holding property of a tank.

SUMMARY AND OBJECTS OF THE INVENTION

The invention relates to a single-stage suspension system for the inner vessel within an outer vessel of a Dewar-type cryogenic tank, a suspension system which prevents low-frequency resonant vibrations, which can withstand large dynamic forces, and which inhibits heat transfer between the two vessels.

The system consists of a hollow open ended support tube which fits inside an external shell and surrounds all or a portion of the inner storage tank. The large radius of the support tube (relative to the storage tank) provides a single-stage suspension of the system which prevents resonant vibrations of the system at low frequencies. Thus, low frequency vibrations generated by an external source, such as a transporting vehicle, do not lessen the integrity of the system, thereby protecting the contents of the cryogenic tank. Moreover, the large radius of the support tube allows the storage system to withstand large forces. The support tube is attached to the external shell at one or more contact points or surfaces, and is also attached to the inner storage tank at one or more similar, attaching contact points or surfaces. The contact points are positioned and the thickness of the support tube is selected such that the requirements of low heat conduction, high strength and no low frequency resonances are met. Suitable insulation (e.g., multilayer insulation and gas evacuation) is employed in the spaces between the storage tank and the external shell. The path of thermal conduction from the external shell to the stored cryogen is through the suspension tube via its contact points with the external shell, along the support tube and through its contact points with the inner storage tank and through the inner storage tank, itself.

Therefore, the objects of the present invention are to provide a cryogenic tank support system which:

a. is mechanically structured to withstand high-amplitude forces to which the system is subjected.

b. utilizes an interconnecting structure that minimizes thermal conductivity.

c. maximizes capacity of an internal storage tank for predetermined dimensions of an external protecting shell; and d. is designed to prevent destructive, resonant vibrations of the system at low frequencies.

DETAILED DESCRIPTION

Figure 1A:
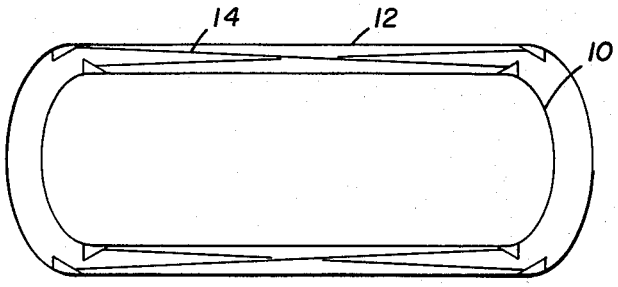
FIG. 1a PRIOR ART
FIG. 1*a* shows a prior art cryogenic tank support system which utilizes support rods.
Figure 1B:
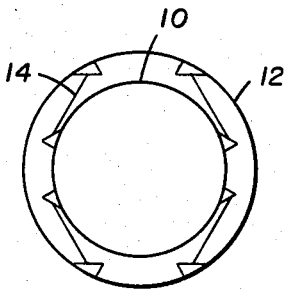
FIG. 1b PRIOR ART
FIG. 1*b* is a sectional end view of the FIG. 1*a* prior art device showing different support rods.

Shown in FIGS. 1*a* and 1*b* is a schematic of a commonly used Dewar-type cryogenic tank in which an internal tank 10 is suspended within an external tank 12 by support rods 14. Each of the support rods 14, usually made of stainless steel, must be properly positioned, secured, and tensioned to suspend effectively the internal tank 10. For vaporization rates of the cryogen of the order of 1 percent per day, this type of suspension has the disadvantage of being able to withstand forces of no more than a few "g's."

Figure 2A:
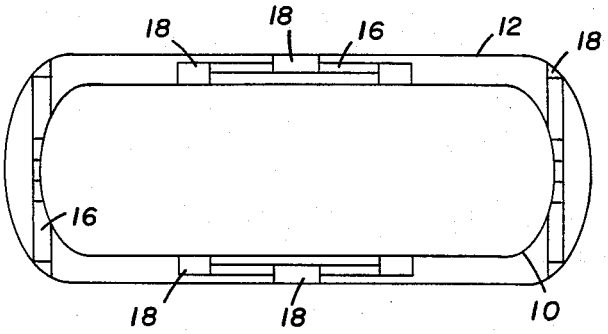
FIG. 2a PRIOR ART
FIG. 2*a* depicts another prior art cryogenic tank support system that employs composite support straps.

A known single-stage cryogenic tank system is schematically shown in FIG. 2*a*, wherein composite support straps 16 are tensioned to support an internal tank 10 within a protective external tank 12 via securing points 18. Calculations have shown that this system can be free of low resonant frequencies, depending on the tension of the support straps 16. This complex solution, originally proposed to meet frequency requirements, has several drawbacks. The use of straps for support requires an exact tuning of strap tension to insure non-failure of the system. A mis-tuned support strap 16 may snap, increasing the tension in the remaining straps, which, in turn, causes additional strap failures. The arrangement of support straps 16 and securing points 18 consumes valuable storage space by limiting the size of the internal tank 10, assuming maximum dimensions for the external tank 12 are predetermined.

Figure 2B:
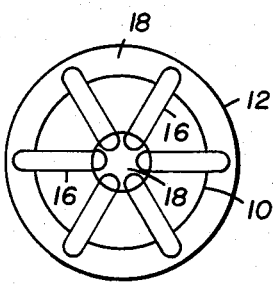
FIG. 2b PRIOR ART
FIG. 2*b* shows the FIG. 2*a* apparatus in a sectional, end view.

FIG. 2*b* provides a sectional end view with the composite support straps arranged in a spoked pattern.

Figure 3A:
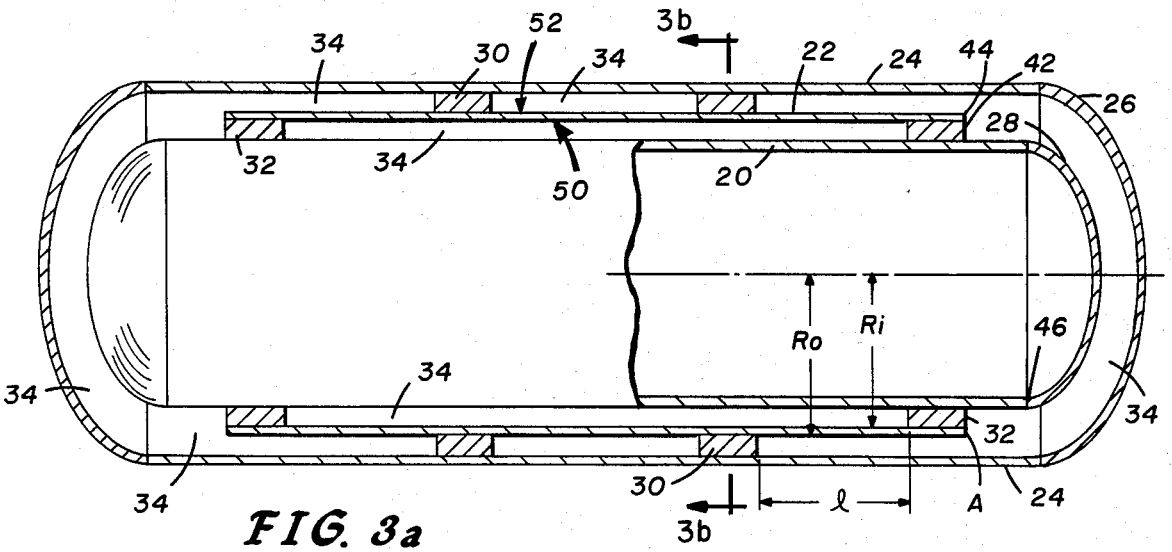
FIG. 3*a* is a sectioned elevation of the preferred embodiment of the invention.

FIG. 3*a* illustrates the general configuration of the invention drawn to a cryogenic tank support system which overcomes the deficiencies of other devices. The system comprises, in part, an internal storage tank 20 in which a cryogenic fluid is stored, a support tube 22 that surrounds and provides structural support to the internal storage tank 20, and an external shell 24 that encloses the internal storage tank 20 and support tube 22. Internal storage tank 20 and external shell 24 may be formed from any material commonly used in the construction of Dewar-type cryogenic tanks, such as steel. Support tube 22 is preferably made of a material having a high strength to thermal conductivity ratio, such as fiberglass/epoxy composite. In this manner, a high-strength tank system can be realized that protects against dynamic loading, does not have low frequency resonances, and which also inhibits heat flow from the environment to the cryogen.

In this preferred embodiment, the internal storage tank 20 is cylindrical. Two rounded ends 28 are secured in a known manner to opposite ends 46 of the internal storage tank 20 to contain the cryogenic fluid therein. The support tube 22 consists of a hollow, open-ended, suspension tube having an outer radius "$R_o$", and an inner radius "$R_i$", and a cross-sectional area "A", that surrounds the internal storage tank 20, the rounded ends 28 being exposed. The internal storage tank 20 is attached to the ends of support tube 22 in a first area of contact by annular cold attachment rings 32. The cold, internal attachment rings 32 contact the internal storage tank 20 in which a cryogenic fluid (in the case of liquid oxygen at atmospheric pressure, −297° F.) is generally stored, and are therefore referred to as "cold" attachment rings. Conversely, external (relative to the support tube 22), hot attachment rings 30 contact the external shell 24 which is subjected to the higher temperatures of the system environment and contact the external surface wall 52 of the support tube 22 in a second area of contact. As shown, either of the hot attachment rings 30 is separated from an adjacent cold attachment ring 32 by a distance "l". A temperature gradient exists along the length of the support 2 in the direction of "l" between the hot and cold attachment rings 30 and 32, respectively. Supported on the hot attachment rings 30 is the external shell 24 which is also cylindrical and, with its rounded caps 26 (attached in a known manner) fully encloses the support tube 22 and internal storage tank 20. The space 34 between the external shell 24 and the internal storage tank 20, except for the space occupied by the support tube 22, the hot attachment rings 30, the cold attachment rings 32, and by other items, such as pipes, sensors, etc. (not shown in FIG. 3*a*), contains suitable insulation. For instance, this space 34 may be filled with a multilayer insulation material and gas evacuated, and is divided into sections according to the relative placement of the hot and cold attachment rings 30, 32. As an example, FIG. 3*a* shows a first section of space 34 defined by the internal storage tank 20, cold attachment rings 32 and the support tube 22. A second section is defined as being inside the external shell 24 with its rounded caps 26 and exterior to the support tube 22 and the internal storage tank 20 with its rounded ends 28. The cold attachment rings 32 are attached to the internal storage tank 20, and the hot attachment rings 30 are attached to the external shell 24 by welding, for instance. The attachment of the support tube 22 to the cold attachment rings 32 and the hot attachment rings 30 takes into account the contraction of the internal storage tank 20, the cold attachment rings 32 and the support tube 22, which is due to the introduction of cryogen into the internal storage tank 20 which is initially at ambient temperature. For instance to provide for longitudinal contraction in the parts of FIG. 3*a* both hot attachment rings 30 and one cold attachment ring 32 may be fixed in position on the support tube 22, and one cold attachment ring 32 may be attached to the support tube 22 with provision for longitudinal movement along the support tube 22.

In the case of a stored mass, such as a superconducting magnet cryostat, the mass is secured to the system in the same manner as the internal storage tank 20. That is, the mass is supported directly by the cold attachment rings 32. Obviously, such a stored mass may have any shape.

The system of necessary piping and controls for delivery of the cryogenic fluid into and from within the internal storage tank 20, the sensors or sensor connections usually incorporated in a cryogen storage tank, and the provisions which need to be made to account for the changes in the dimensions of these parts upon cooling and heating are well known in the art and, therefore, need not be discussed further.

Figure 3B:
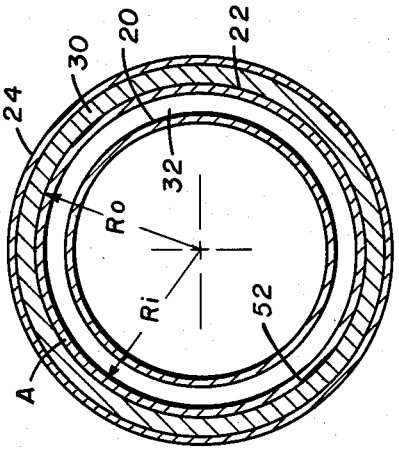
FIG. 3*b* is a cross-sectional view of the embodiment shown in FIG. 3*a*.

FIG. 3*b* is a sectional view through a hot attachment ring 30 of the device shown in FIG. 3*a*. As shown, the hot attachment ring 30 is a continuous ring completely surrounding the support tube 22. The hot attachment ring 30, however, need not be continuous; it may consist of a finite number of sections of a continuous ring. Similarly, the cold attachment ring 32 may consist of a finite number of ring sections. Thus, as used herein, "ring" refers to a continuous ring or ring sections.

Figure 4:
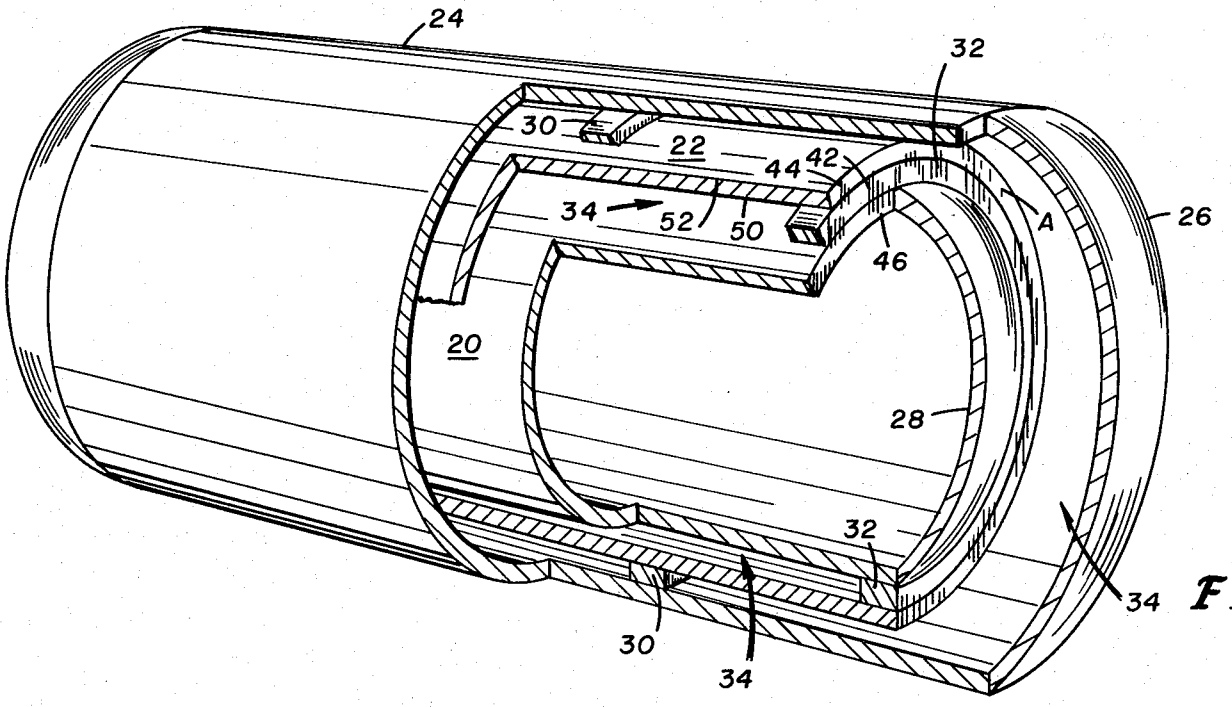
FIG. 4 is a perspective of the invention in its preferred embodiment.

FIG. 4 is a cutaway of the invention as portrayed in FIGS. 3*a* and 3*b*, and illustrates the relative positioning of the cylindrical structures 20, 22 and 24; the rounded caps 26 and 28; and the insulation space 34.

The cryogenic tank support system, according to the invention, is designed to meet three requirements. The first requirement is that the rate of heat conduction along the elements of the support system must be less than a predetermined value. A second requirement is that the different natural frequencies of the internal storage tank 20 (when empty to full of cryogen) must exceed a predetermined number of cycles per second. The third requirement is that the cryogenic tank support system can withstand dynamic forces having amplitudes up to a desired value.

To satisfy the thermal requirement and to surpass the frequency and dynamic force requirements as much as is possible, it is necessary that the radius $R_o$ of the support tube 22 be as large as possible. This is evident when the heat conduction, the natural bending frequency, and the bending stress are expressed in terms of the dimensions of the support tube. The rate of heat conduction "Q" along the elements of the support system is proportional to A/l where $A=\pi(R_o^2-R_i^2)$ is the cross-sectional area of the support tube 22 ($R_o$ is the outer radius and $R_i$ is the inner radius of the support tube 22, and l is the length along the support tube 22 between a hot attachment ring 30 and an adjacent cold attachment ring 32). See FIG. 3*a*. A temperature gradient, which is the driving force for "Q", exists along the length of the support tube in the direction of "l" between the hot and cold attachment rings, 30 and 32, respectively. The resonant bending frequency "f" of the support tube 22 supported at two points a distance l apart is approximately proportional to $I^{1/2}/l^{3/2}$, where "I"$=\pi/4\ (R_o^4-R_i^4)$ is the moment of inertia of the support tube 22. The bending stress $\sigma_B$ in the support tube 22 (treated as a beam of length l) is approximately proportional to $R_o l/I$.

These requirements are summarized below, where $I=(A/2)(R_o^2)$ for a thin-walled tube ($R_o-R_i<<R_o$) has been used:

1. Heat Conduction $$Q \propto \frac{A}{l}$$

(desire Q to be small)

2. Beam Bending Frequency $$f \propto \frac{I^{1/2}}{l^{3/2}} \propto \left[\frac{A}{l}\right]^{1/2} \frac{R_o}{l}$$

(desire f to be large)

3. Beam Bending Stress $$\sigma_B \propto \frac{R_o l}{I} \propto \frac{1}{(A/l) R_o}$$

(desire $\sigma_B$ to be small)

The derivation and validity of these three relationships are considered to be well known in the art and are therefore not discussed at further depth. However, derivation of the heat conduction equation 1 is evident from the discussion at page 464 at Eq. (7–22) of *Cryogenic Systems* by R. Barron, McGraw-Hill Book Co., 1966. The equations 2 and 3 relating to beam dynamics for a thin-walled tube are simple derivations of the formulas presented in *Shock and Vibration Handbook*, C. M. Harris and C. E. Crede, McGraw-Hill Book Co., 1976, page 1–13; and *Kent's Mechanical Engineer's Handbook*, C. Carmichael, John Wiley and Sons, 1950, page 8–08, Eq. (6), respectively.

In the design of a Dewar-type cryogenic storage tank, one may begin by setting a maximum vaporization rate for a given stored cryogen, thereby setting an upper limit to the total rate of heat transfer into the cryogen by radiation, convection, and conduction. Calculations are made of the various parts of this total rate of heat transfer so that a desired maximum rate of heat conduction along the support members may be set. For this embodiment, a maximum A/l is set for a support tube 22 of a given material. Thus, any remaining parameters of the cryogenic tank support system must be adjusted accordingly. With this constraint on A/l, $R_o$ (the support tube 22 outer radius) becomes the next adjustable variable appearing in both the frequency and stress expressions, from which it is readily apparent that $R_o$ should be as large as possible. The maximum value for $R_o$ is governed by the internal dimensions of the cylindrical portion of the external shell 24, which, in turn, is determined by the space which may be available for the cryogenic tank. After choices are made for A/l and $R_o$, the resonant frequency can still be varied through the length parameter,. However, variation of the length parameter, l, subject to the constraint that A/l is a constant requires a corresponding variation in the wall thickness, $t=R_o-R_i$, of the support tube 22, since the cross-sectional area of the support tube 22 is related to t by the expression $$A=\pi(R_o^2-R^2)=\pi(R_o+R_i)t.$$

A solution to the three equations 1, 2 and 3 is acceptable as long as the wall thickness, t, of the support tube 22 is sufficiently large to meet standards of structural integrity, and insofar as the three equations adequately describe the functional relationship of Q (equation 1), f (equation 2) and $\sigma_B$ (equation 3) on $R_o$, l, and A/l.

Figure 5:
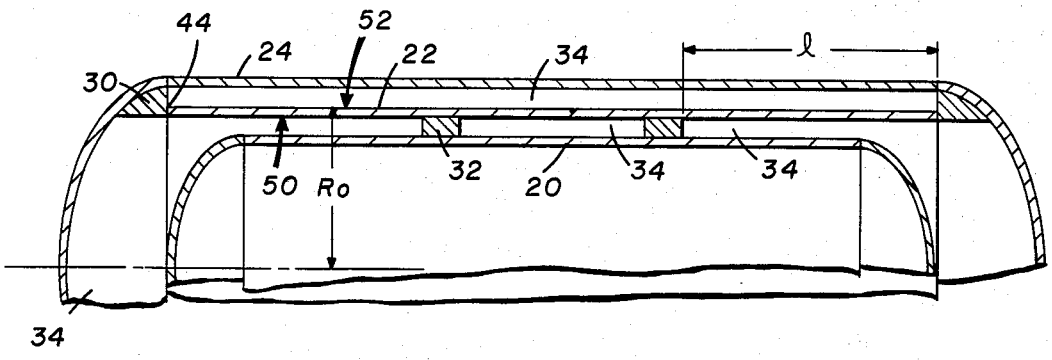
FIG. 5 depicts a variation of the invention shown in FIG. 3*a*.
Figure 6A:
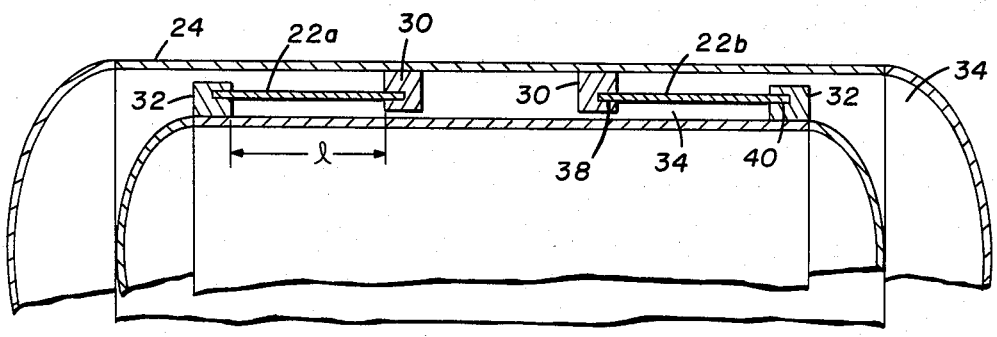
FIG. 6*a* shows an additional embodiment which utilizes two tubular support sections.
Figure 6B:
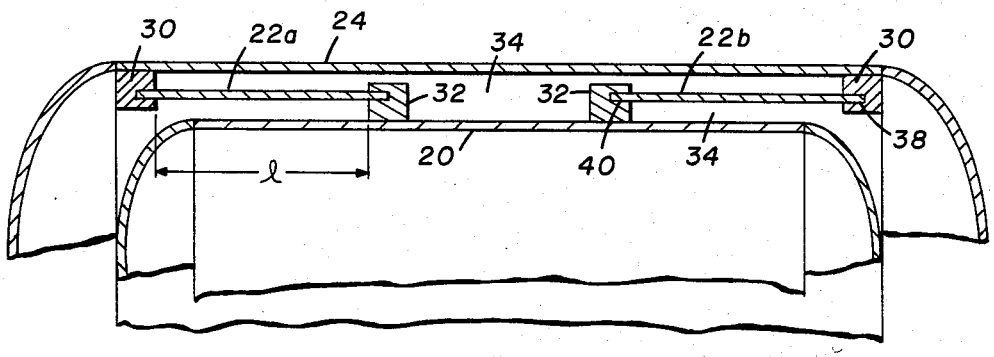
FIG. 6*b* is a variation of the FIG. 6*a* embodiment.
Figure 7A:
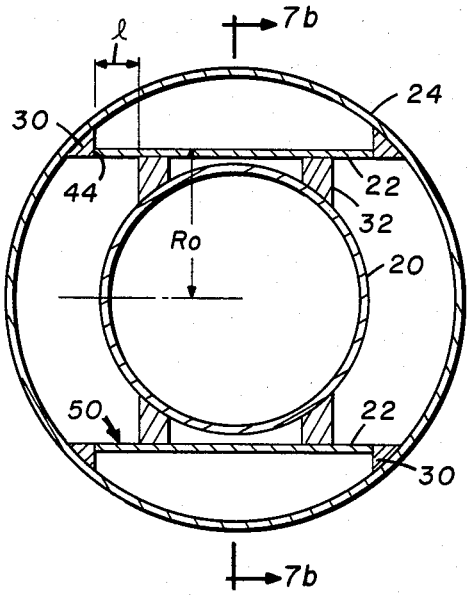
FIG. 7*a* is an elevation view of a spherical embodiment of the invention.
Figure 7B:
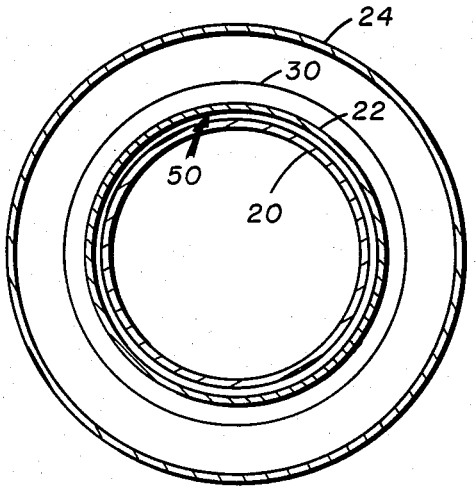
FIG. 7*b* is a cross-section of the FIG. 7*a* device.
Figure 8A:
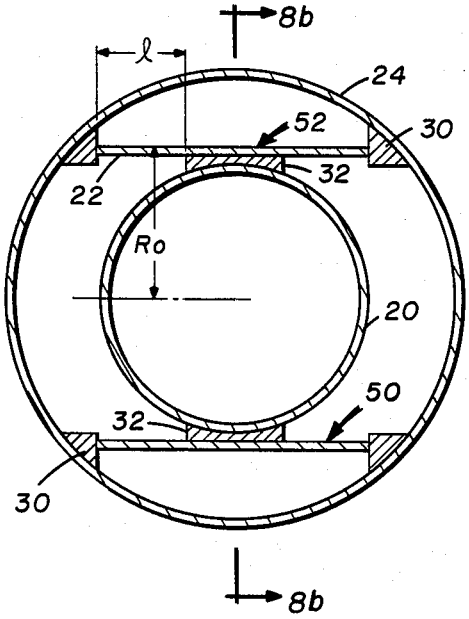
FIG. 8*a* depicts another spherical embodiment of the invention.
Figure 8B:
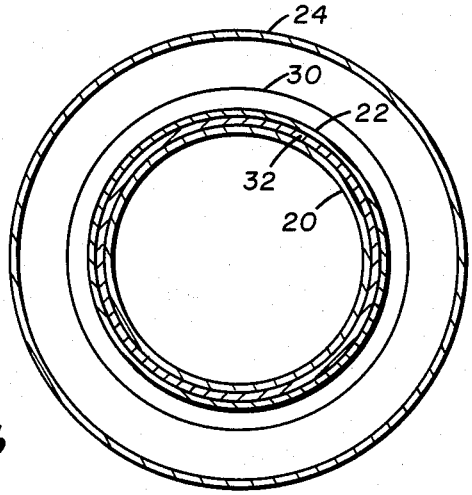
FIG. 8*b* shows the cross-section of the embodiment represented in FIG. 8*a*.

Turning now to FIG. 5, a variation of the FIGS. *3a*, *3b* embodiment is shown in which the relative longitudinal positions of the hot attachment rings 30 and cold attachment rings 32 are reversed. The hot attachment rings 30 attach the external shell 24 to the support tube 22. The cold attachment rings 32 are positioned between the hot attachment rings 30 along the inside surface wall 50 of the support tube 22 and surround the internal storage tank 20.

It is to be noted with reference to FIGS. *3a* and 4 that the portion of the support tube 22 between the two hot attachment rings 30 is not essential to the application of this invention. Similarly, in FIG. 5 the portion of the support tube 22 between the two cold attachment rings 32 is not essential to the application of this invention. Embodiments of this variation are shown in FIGS. *6a* and *6b* to which the general principles of FIGS. *3a*, *3b*, 4 and 5 also apply.

FIG. *6a* shows another embodiment of the invention utilizing two tubular support sections *22a*, *22b*, each of which is connected to one hot attachment ring 30 and one cold attachment ring 32 by means of slots 38 and 40 for instance. Again, l is the distance between a hot attachment ring 30 and an adjacent cold attachment ring 32. A variation of this embodiment is depicted in FIG. *6b*, wherein the hot attachment rings 30 and cold attachment rings are reversed, longitudinally.

Though the embodiments portrayed thus far are drawn to cylindrical structures of circular cross-sections, the present invention can be realized in cylinders having any cross-sectional shape. For instance, the internal storage tank 20, support tube 22, and external shell 24 may have general ellipsoidal cross-sections. Although the internal tank 20, the support tube 22, and the external shell 24 will usually have the same shape in their cross-sections, there is no requirement of having the same shape in cross-section for the application of this invention. The formulas for beam bending stress and beam bending frequency would vary according to the cross-sectional shape of the support tube 22, but the general principles of the invention would continue to apply. In the case of non-circular cross-sections of the internal storage tanks 20, support tube 22, or the external shell 24 the attachments 30 and 32 will normally take the shape of these connecting members 20, 22 or 24, and thus, will not necessarily be circular rings. Moreover, the present invention can be realized wherein the internal storage tank 20 and the external shell 24 are not cylindrical. As an example, FIGS. *7a* and *7b* show a spherical external shell 24 and a spherical internal storage tank 20. However, the support tube 22 is cylindrical and is attached at its ends 44 to the external shell 24 via the hot attachment rings 30. Cold attachment rings 32 attach the spherical internal storage tank 20 to the support tube 22 at its inside surface wall 50. As discussed earlier, the relative locations of the hot and cold attachment rings 30, 32 may be reversed.

FIGS. *8a* and *8b* show a variation from the embodiment shown in FIGS. *7a* and *7b*. However, only one cold attachment ring is shown encircling the support tube 22, instead of two attachment rings as in FIG. *7a*. Another variation (not shown) would include one hot attachment ring 30 surrounding the external surface 52 of the support tube 22 and contacting and connected to the external shell 24, and two cold attachment rings 32 engaging the internal storage tank 20 and support tube 22 at its inside surface wall 50. Similar variations (not shown) from the embodiments shown in FIGS. *3a* and 5 are possible. In FIG. *3a* the two hot attachment rings 30 can be replaced with one central hot attachment ring and in FIG. 5 the two cold attachment rings 32 can be substituted with one cold attachment ring.

The cryogenic tank support system may have, not only any cross-section, but any number of attachment rings with a minimum of one cold attachment ring 32 and a minimum of one hot attachment ring 30, and any number of attachment ring arrangements. For instance, rather than both hot attachment rings 30 being between the cold attachment rings 32, the hot/cold attachment rings 30, 32 may alternate. That is, one end 44 of the support tube 22 may be secured by one hot attachment ring 30, adjacent to a cold attachment ring 32, followed longitudinally by another hot attachment ring, and secured at the other support tube end 44 by a cold attachment ring. Furthermore, a particular placement of the hot attachment rings 30 or the cold attachment rings 32 is not required. As an example, the hot attachment rings 30 of FIG. 5 need not be attached to the rounded caps 26, as shown, but may be attached to the external shell 24 closer to the cold attachment rings 32, or may be attached to the rounded caps 26 closer to the longitudinal axis of the cryogenic system. Similarly, the cold attachment rings 32 in FIGS. 3*a* and 4 need not be positioned such that the outer edge 42 of the cold attachment ring 32 is flush with the end 44 of the support tube 22 and the end 46 of the cylindrical portion of the internal storage tank 20, but may be positioned away from but still on the cylindrical portion of the internal storage tank 20, or on the rounded caps 28. Also, the cold attachment rings 32 may be integral with the support tube 22 or the internal storage tank 20, and the hot attachment rings 30 may be integral with the support tube 22 or the external shell 24. It is to be noted that although FIGS. 3*a*, 4, 5, 6*a*, 6*b*, 7*a* and 8*a* are drawn with a horizontal orientation of the cylindrical support tube 22, any orientation of the support tube 22 is possible. In a specific application of this invention the actual orientation of the support tube 22 may be determined from consideration of the magnitudes and directions of the expected forces on the internal storage tank 20 and its contents. Other modifications are apparent to one skilled in the art which do not depart from the spirit of the invention. The described embodiments are, therefore, considered to be only illustrative and not restrictive; the scope of the invention being defined by the appended claims.

What is claimed is:

1. A support system for an internal mass at a first temperature comprising:

an internal mass;

a support tube with a longitudinal axis and a cross sectional area, surrounding the internal mass and attached thereto via a first area of contact;

an external shell at a second temperature enclosing the support tube and attached thereto via a second area of contact which is positioned a predetermined distance along the support tube axis from the first area of contact such that a substantial temperature gradient exist through the support tube area between first and second areas of contact;

wherein the support tube is dimensioned such that beam dynamics apply thereto; and the support system is a single-stage system dimensioned to not have a natural frequency below a predetermined frequency.

2. A support system as defined in claim 1, the first area of contact comprising at least one internal attachment ring which encircles the internal mass and contacts the support tube and the second area of contact comprising at least one external attachment ring which encircles the support tube and contacts the external shell.

3. A support system as defined in claim 2, the at least one internal attachment ring comprising two internal attachment rings positioned along the internal mass and defining a first insulation section with the internal mass and support tube, and the at least one external attachment ring comprising two external attachment rings positioned along the support tube and defining a second insulation section with the support tube and external shell.

4. A support system as defined in claim 3, the support tube comprising first and second ends and a surface wall, wherein one of the two internal attachment rings is secured to the first end and the other of the two internal attachment rings is secured to the second end, and wherein the two external attachment rings are secured to the surface wall longitudinally between the two internal attachment rings.

5. A support system as defined in claim 3, the support tube comprising first and second ends and a surface wall, wherein one of the two external attachment rings is secured to the first end and the other of the two external attachment rings is secured to the second end, and wherein the two internal attachment rings are secured to the surface wall longitudinally between the two external attachment rings.

6. A support system as defined in claim 2, the support tube comprising at least two tubular sections, the at least one external attachment ring comprising two external attachment rings, wherein one of the at least two tubular sections is attached to one of the two external attachment rings and the at least one internal attachment ring, and the other of the two tubular sections is attached to the other of the two external attachment rings and the at least one internal attachment ring.

7. A support system as defined in claim 2, the support tube comprising at least two tubular sections, the at least one internal attachment ring comprising two internal attachment rings, wherein one of the at least two tubular sections is attached to one of the two internal attachment rings and the at least one external attachment ring, and the other of the two tubular sections is attached to the other of the two internal attachment rings and the at least one external attachment ring.

8. A support system as defined in claim 2, the at least one internal attachment ring comprising two internal attachment rings, the at least one external attachment ring positioned on the support tube longitudinally between the two internal attachment rings.

9. A support system as defined in claim 2, the at least one external attachment ring comprising two external attachment rings, the at least one internal attachment ring positioned on the support tube longitudinally between the two external attachment rings.

10. A tank support system comprising the following elements:

an internal storage tank;

two internal attachment rings;

a support tube with a longitudinal axis and a cross sectional area, surrounding the internal storage tank and connected thereto via the two internal attachment rings;

a first insulation section defined by the internal storage tank, the two internal attachment rings and the support tube;

at least one external attachment ring separated a distance along the support tube axis from an adjacent one of the two internal attachment rings such that a substantial temperature gradient exists through the support tube area between the at least one external attachment ring and the adjacent internal attachment ring;

an external shell enclosing the support tube and connected thereto via the at least one external attachment ring;

a second insulation section defined by the support tube and external shell; wherein the elements as connected provide a single-stage tank support system and the support tube is dimensioned such that beam dynamics apply thereto.

11. A tank support system as defined in claim 10 the support tube comprising first and second ends and a surface wall, wherein one of the two internal attachment rings is secured to the first end and the other of the two internal attachment rings is secured to the second end, and wherein the at least one external attachment ring is secured to the surface wall longitudinally between the two internal attachment rings.

12. A tank support system as defined in claim 10, the support tube comprising first and second ends and a surface wall, wherein the at least one external attachment ring comprises two external attachment rings and wherein one of the two external attachment rings is secured to the first end and the other of the two external attachment rings is secured to the second end, and wherein the two internal attachment rings are secured to the surface wall longitudinally between the two external attachment rings.

13. A tank support system as defined in claim 10 the support tube comprising two support tube sections, wherein one of the two support tube sections is attached to one of the two internal attachment rings and the at least one external attachment ring, and the other of the two support tube sections is attached to the other of the two internal attachment rings and the at least one external attachment ring.

14. A tank support system as defined in claim 13, the support tube comprising two support tube sections, the at least one external attachment ring comprising two external attachment rings, wherein one of the two support tube sections is attached to one of the two external attachment rings and one of the two internal attachment rings, and the other of the two support tube sections is attached to the other of the two external attachment rings and the other of the two internal attachment rings.

15. A tank support system as defined in claim 11 comprising a cryogenic tank support system, each internal attachment ring comprising a cold attachment ring, and each external attachment ring comprising a hot attachment ring.

16. A tank support system as defined in claim 12 comprising a cryogenic tank support system, each internal attachment ring comprising a cold attachment ring, and each external attachment ring comprising a hot attachment ring.

17. A tank support system as defined in claim 13 comprising a cryogenic tank support system, each internal attachment ring comprising a cold attachment ring, and each external attachment ring comprising a hot attachment ring.

18. A tank support system as defined in claim 14 comprising a cryogenic tank suppport system, each internal attachment ring comprising a cold attachment ring, and each external attachment ring comprising a hot attachment ring.

* * * * *